US005468403A

United States Patent [19]

Romanelli et al.

[11] Patent Number: 5,468,403

[45] Date of Patent: Nov. 21, 1995

[54] PHOSPHORUS- AND MONO- OR DI-SULFIDE-CONTAINING ADDITIVES FOR LUBRICATION OILS

[75] Inventors: Michael G. Romanelli, Brooklyn, N.Y.; Raymond F. Watts, Long Valley; Maryann Devine, Lincroft, both of N.J.

[73] Assignee: Exxon Chemical Patents Inc., Linden, N.J.

[21] Appl. No.: 173,731

[22] Filed: Dec. 22, 1993

[51] Int. Cl.[6] ..... C10M 135/20

[52] U.S. Cl. ..... 252/47.5; 252/49.9

[58] Field of Search ..... 252/47.5, 49.9

[56] References Cited

U.S. PATENT DOCUMENTS

| | | | |
|---|---|---|---|
| 4,014,803 | 3/1977 | Romine | 252/32.7 R |
| 4,028,258 | 6/1977 | Kablaoui et al. | 252/46.7 |
| 4,234,435 | 11/1980 | Meinhardt et al. | 252/51.5 A |
| 4,237,020 | 12/1980 | Papay et al. | 252/47.5 |
| 4,338,205 | 7/1982 | Wisotsky | 252/32.5 |
| 4,344,853 | 8/1982 | Gutierrez et al. | 252/33.6 |
| 4,397,749 | 8/1983 | Shippey | 252/47.5 |
| 4,411,808 | 10/1983 | Gutierrez et al. | 252/78.1 |
| 4,589,993 | 5/1986 | Cleveland et al. | 252/78.5 |
| 4,664,826 | 5/1987 | Gutierrez et al. | 252/482 |
| 4,702,850 | 10/1987 | Gutierrez et al. | 252/48.2 |
| 4,704,218 | 11/1987 | Horodysky et al. | 252/49.9 |
| 4,776,969 | 10/1988 | Ryer et al. | 252/46.7 |
| 4,857,214 | 8/1989 | Papay et al. | 252/32.5 |
| 4,873,004 | 10/1989 | Beverwijk et al. | 252/32.5 |
| 4,909,952 | 3/1990 | Salomon et al. | 252/48.6 |
| 5,182,037 | 1/1993 | Pialet et al. | 252/47.5 |
| 5,185,090 | 2/1993 | Ryer et al. | 252/46.6 |

FOREIGN PATENT DOCUMENTS

| | | |
|---|---|---|
| 0234377A1 | 9/1987 | European Pat. Off. . |
| 0454380A1 | 10/1991 | European Pat. Off. . |
| 0531000A1 | 3/1993 | European Pat. Off. . |
| WO89/12666 | 12/1989 | WIPO . |

*Primary Examiner*—Jacqueline V. Howard
*Attorney, Agent, or Firm*—T. J. Shatynski

[57] ABSTRACT

An oil-soluble reaction product of at least one nitrogen-containing compound, at least one phosphorus-containing compound, and at least one mono- or di-sulfide-containing alkanol is provided, which improves friction and/or wear performance of a lubrication oil.

9 Claims, No Drawings

PHOSPHORUS- AND MONO- OR DI-SULFIDE-CONTAINING ADDITIVES FOR LUBRICATION OILS

BACKGROUND OF THE INVENTION

1. Field of the Invention

This invention pertains to lubrication oil additives and particularly relates to multi-functional additives which are reaction products of at least one basic nitrogen-containing compound, at least one inorganic phosphorus-containing compound, and at least one mono- or di-sulfide-containing alkanol.

2. Discussion of Related Art

Additives for lubrication oil possessing improved friction, extreme pressure, and anti-wear performance are continually sought, particularly in view of more stringent requirements for these additives.

Various approaches have been suggested for obtaining these benefits. For example, U.S. Pat. No. 4,702,850 discloses a process to improve friction modification properties of a power transmission fluid. The process uses a friction modifying agent comprising the reaction product of a thio-bis-alkanol and an aliphatic hydrocarbon-substituted succinic acid or anhydride.

U.S. Pat. No. 4,857,214 describes compositions useful as anti-wear and extreme pressure additives in lubrication oils and methods for preparing these compositions which comprise oil-soluble reaction products of inorganic phosphorus-containing acids or anhydrides with a boron compound and ashless dispersants, such as alkenyl succinimides.

European Appln. No. 92307448.8 (corresponding to Publication No. 0531000) teaches oil additive concentrates which enhance performance, particularly extreme pressure and anti-wear performance. European Appln. No. 92307448.8 discloses combining at least one oil-soluble additive composition formed by first heating at least one ashless dispersant containing basic nitrogen and/or at least one hydroxyl group with at least one inorganic phosphorus-containing compound (at least one boron-containing compound may be included) and then combining the resulting product with at least one oil-soluble metal-free sulfur-containing anti-wear and/or extreme pressure agent. European Appln. No. 92307448.8 teaches concentrates which require highly reactive (corrosive) sulfur-containing anti-wear or extreme pressure agents to "sulfurize" the phosphorylated dispersant.

Another approach for improving both friction modification and anti-wear properties is found in the additives of the present invention.

SUMMARY OF THE INVENTION

This invention relates to a composition for improving both friction performance and anti-wear properties in lubrication oil by providing an oil-soluble reaction product of (a) at least one basic nitrogen-containing compound, (b) at least one inorganic phosphorus-containing compound, and (c) at least one mono- or di-sulfide-containing alkanol. If desired, the basic nitrogen-containing compound may contain one or more free hydroxyl groups.

Other embodiments of this invention include concentrates and lubrication oil compositions incorporating the reaction product of this invention, as well as a method of improving friction and/or wear performance of a lubrication oil by adding the oil-soluble reaction product described above to the lubrication oil.

This invention uses oil-soluble materials with non-reactive, non-corrosive sulfur-containing species to improve the wear and friction characteristics of the lubrication oil. Notably, the sulfur-containing material alone would not be considered an anti-wear or extreme pressure agent.

DETAILED DESCRIPTION OF THE INVENTION

The reaction product of this invention comprises (a) at least one basic nitrogen-containing compound, (b) at least one inorganic phosphorus containing compound, and (c) at least one mono- or all-sulfide-containing alkanol.

Component (a), i.e., the basic nitrogen-containing compound, can range broadly and can include reaction products of (i) hydrocarbyl-substituted succinic acids and succinic anhydrides with polyamines, (ii) long-chain carboxylic acids with polyamines, and (iii) hydrocarbyl-substituted phenols with aldehydes and polyamines. The basic nitrogen-containing compound may contain one or more free hydroxyl groups.

Suitable basic nitrogen-containing compounds of type (i) include reaction products of hydrocarbyl-substituted succinic acids and succinic anhydrides with polyamines. In general, the number average molecular weight of the hydrocarbyl substituent ranges from about 250 to about 5000, preferably from 400 to 2000, and more preferably from 450 to 1300, in particular 450 to 900. Most preferably, the number average molecular weight is 450. Suitable hydrocarbyl substituents of the succinic acids and succinic anhydrides include alkyl, alkenyl, aryl, cycloalkyl, and hetero-containing analogs thereof. The hetero-containing hydrocarbyl substituents may contain one or more hetero atoms. A variety of hetero atoms can be used and are readily apparent to those skilled in the art. Suitable hetero atoms include, but are not limited to, nitrogen, oxygen, phosphorus, and sulfur. A preferred hetero atom is sulfur.

A preferred hydrocarbyl substituent is alkenyl, preferably derived from a polyolefin. The polyolefin may be derived from a homopolymer or copolymer of one or more olefin monomers having 2 to 16 carbon atoms, preferably from 2 to 6, more preferably from 3 to 4, carbon atoms. The copolymers include random, block, and tapered copolymers. Suitable monomers include ethylene, propylene, butenes, isobutylene, 1-pentene, 1-octene, and diolefins such as butadiene and isoprene. If a diene is used as a monomer, the resulting polymer is preferably hydrogenated to saturate at least 75% of the unsaturated bonds, more preferably all unsaturated bonds. Using an alkenyl substituent derived from a polyisobutylene group is especially preferred. More preferably, the alkenyl substituent is a polyisobutylene group having a number average molecular weight from about 200 to 5000, preferably from 400 to 2000, more preferably from 450 to 1300, in particular 450 to 900, and most preferably 450.

The average number of succinic groups per hydrocarbyl group contained in the hydrocarbyl-substituted succinic acids and succinic anhydrides ranges between 1 and 5, preferably between 1 and 3, and is most preferably 1.

Preparing hydrocarbyl-substituted succinic acids and succinic anhydrides is well known in the art. For example, when the hydrocarbyl group is derived from an olefinic polymer, the olefinic polymer and maleic acid or maleic anhydride may simply be heated together to cause a thermal "ene" reaction, as disclosed in U.S. Pat. Nos. 3,361,673 and 3,401,118, which are incorporated by reference.

In addition, the olefinic polymer can first be halogenated. For example, the olefinic polymer can be chlorinated or brominated to achieve a chlorine or bromine content of about 1 to 8 wt. %, preferably 3 to 7 wt. %, based on the weight of polymer. To halogenate an olefinic polymer, a halogen can be passed through the olefinic polymer at a temperature of 600° to 250° C., preferably 120° to 160° C., for about 0.5 to 10 hours, preferably 1 to 7 hours. The halogenated polymer may then be reacted with maleic acid or maleic anhydride at a temperature of about 100° to 250° C., preferably 180° to 235° C., for about 0.5 to 10 hours, typically 3 to 8 hours. The amount of acid or anhydride should be sufficient to obtain a product containing the desired number of moles of succinic acid or succinic anhydride per mole of the halogenated polymer. Processes of this general type are taught in U.S. Pat. Nos. 3,087,936; 3,172,892; and 3,272,746, which are incorporated by reference.

Alternatively, the olefinic polymer and the maleic acid or maleic anhydride can be mixed and heated while the halogen is added to the hot material. Processes of this type are disclosed in U.S. Pat. Nos. 3,215,707; 3,231,587; 3,912,764; and 4,110,349 and U.K. 1,440,219, which are incorporated by reference.

About 65 to 95 wt. % of the polyolefin, e.g., polyisobutylene, will normally react with the maleic acid or maleic anhydride if halogenation has previously been conducted. Therefore, because halogenation aids reactivity, only about 50 to 75 wt. % of the polyisobutylene will react if the thermal reaction is conducted without halogenation or the use of a catalyst.

The hydrocarbyl-substituted succinic acids or succinic anhydrides can then be reacted with a polyamine containing at least 2 total carbon atoms, preferably 2 to 60, more preferably 3 to 15. Suitable polyamines contain at least 2 nitrogen atoms, preferably 3 to 15, more preferably 3 to 12, most preferably 3 to 9 nitrogen atoms. At least one of the nitrogen atoms is part of a primary amine group and at least one (preferably at least two) of the remaining nitrogen atoms is part of a primary or secondary amine group.

The polyamines may be hydrocarbyl amines or substituted hydrocarbyl amines. Substituents include, for example, hydroxy groups, alkoxy groups, amide groups, nitriles, imidazoline groups, and the like. Hydroxyl amines with 1 to 6 hydroxy groups, preferably 1 to 3 hydroxy groups, are particularly useful. Preferred amines are aliphatic saturated mines, including those of formula I and formula II:

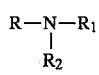

(I)

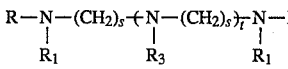

(II)

wherein R, $R_1$, $R_2$, and $R_3$ are independently selected from the group consisting of hydrogen, $C_1$ to $C_{25}$ straight or branched chain alkyl radicals, alkoxy substituted alkylene radicals containing a total of 2 to 26 carbon atoms, hydroxyalkylamino substituted alkylene radicals containing a total of 2 to 26 carbon atoms, and alkylamino substituted alkylene radicals containing a total of 2 to 26 carbon atoms; s represents an integer from 2 to 6, preferably 2 to 4; and t represents a integer from 0 to 10, preferably 2 to 7, more preferably 3 to 7.

Preferred polyamine compounds are formula II compounds containing at least two primary amine groups and at least one, preferably at least three, secondary amine groups.

Examples of preferred polyamines include polyethylene amines such as diethylene triamine, triethylene tetraamine, tetraethylene pentaamine; polypropylene mines such as di-(1,2-propylene)triamine and di-(1,3-propylene)triamine; and mixtures thereof.

$R_3$ in formula (II) can also represent a moiety of formula III:

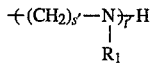

(III)

wherein $R_1$ is as defined above; s' represents an integer from 2 to 6, preferably 2 to 4; and t' represents an integer from 0 to 10, preferably 2 to 7, more preferably about 3 to 7.

Preferably, when $R_3$ represents a moiety of formula (III), the following provisos apply:

(1) the sum of t and t' is not greater than about 15;

(2) the total number of nitrogen atoms in a moiety of formula (III) is at least two, preferably at least three, more preferably about three to fifteen.

Suitable polyamines will readily react with the hydrocarbyl-substituted succinic acids and succinic anhydrides. Typically, an oil solution containing 5 to 95 wt. % of a hydrocarbyl-substituted succinic acid or succinic anhydride and 95 to 5 wt. % of a polyamine is heated to about 100° to 250° C., preferably 125°to 175° C. for about 1 to 10 hours, preferably 2 to 6 hours, until the desired mount of water is removed. Preferred products of these reactions are characterized by containing structures such as A, B, and mixtures thereof:

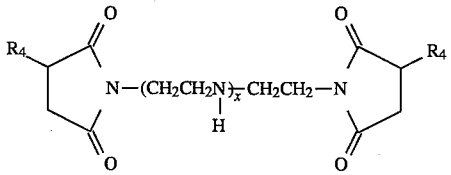

(A)

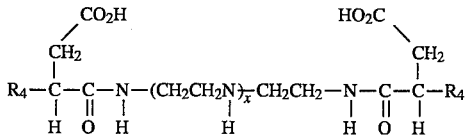

(B)

wherein $R_4$ represents a polyisobutylene moiety having a molecular weight of approximately 200 to 5000, preferably 450, and x is an integer from 2 to 6, preferably 3.

Suitable basic nitrogen-containing compounds of type (ii) include the reaction product of long-chain mono- or polycarboxylic acids with polyamines. Suitable carboxylic acid reactants include homopolymers or copolymers of $C_2$ to $C_{12}$ olefins terminated with a carboxyl group. For example, the carboxylic acid may be formed by reacting an olefinic homopolymer or copolymer with acrylic acid. The carboxylic acid may also be formed by the addition of carbon monoxide and water to the olefinic homopolymer or copolymer using a boron trifluoride catalyst. This method is known as the Koch reaction.

Preferred carboxylic acid reactants include aliphatic mono acids (fatty acids) characterized by formula IV:

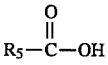

(IV)

wherein $R_5$ is a straight chain or branched, saturated or unsaturated, aliphatic hydrocarbyl radical containing from 9 to 29 carbon atoms, preferably from 11 to 23 carbon atoms.

$R_5$ is preferably a straight chain aliphatic hydrocarbyl radical; however, limited branching and short side chains (e.g., those introduced by using a material such as polybutene) are acceptable. The molecular weight of the $R_5$ group typically ranges from 100 to 1000, preferably from 150 to 750, more preferably from 200 to 400.

The term "hydrocarbyl" as applied to $R_5$ of formula (IV) includes predominantly hydrocarbyl groups as well as purely hydrocarbyl groups. The term "predominantly hydrocarbyl" excludes non-hydrocarbyl substituents or non-carbon atoms significantly affecting hydrocarbyl characteristics or properties relevant to their use in the present invention. For example, a $C_{20}$ alkyl group substituted with a methoxy substituent having substantially similar properties to a purely hydrocarbyl $C_{20}$ alkyl group would be considered "predominantly hydrocarbyl".

Non-limiting examples of substituents that do not significantly alter hydrocarbyl characteristics or properties include the following:

(A) ether groups (preferably hydrocarbyloxy groups such as phenoxy, benzyloxy, methoxy, n-isotoxy, etc. and alkoxy groups of up to ten carbon atoms);

(B) oxo groups (for example,-O-linkages in the main carbon chain);

(C) ester groups (for example, COO-hydrocarbyl);

(D) sulfonyl groups (for example,

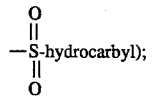

(E) sulfinyl groups (for example,

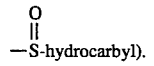

Suitable fatty acids may be derived from natural sources or manufactured synthetically. Sulfurized versions of the fatty acids may also be used.

These fatty acids may be reacted with polyamines of the type previously discussed. The reaction can occur at temperatures from about 120° to 250° C. and for a period of about 1 to 12 hours. The proportion of fatty acid per mole of amine reactant can range from about 0.1 to 10 molar equivalents. Preferably, the molar ratio of fatty acid to polyamine is from about 2.5 to 7 molar equivalents, most preferably about 3 to 5. Preferred polyamines are the polyethylene amines previously described.

Preferred carboxylic acid-polyamine reaction products may be characterized by structure C:

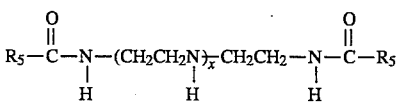

(C)

wherein $R_5$ represents an alkyl chain of about 10 to 30 carbon atoms, preferably 17, and x is an integer from 2 to 6, preferably 3.

Commercially available fatty acids usually contain mixtures of acids and are suitable for use in the invention. Thus, commercially available oleic acid contains, for example, stearic, palmitic, and linoleic acids.

Suitable basic nitrogen-containing compounds of type (iii)include reaction products of hydrocarbyl-substituted phenols with aldehydes and polyamines. Suitable hydrocarbyl substituent groups are the same as previously described for use with the succinimides and succinimides. Preferred hydrocarbyl groups are alkenyls derived from a polyolefin having a number average molecular weight ranging from 250 to 5000, preferably from 400 to 2000, more preferably from 450 to 500. Suitable aldehydes include $C_1$ to $C_6$ aldehydes. A preferred aldehyde is formaldehyde. Preferred polyamines are the polyethylene mines previously described.

Preparation of the basic nitrogen-containing compounds of type (iii) is analogous to and/or can include well-known methods used to prepare Mannich condensation products. Such methods are described in, for example, U.S. Pat. Nos. 3,649,229; 3,803,039; and 3,980,569. The disclosures of these U.S. patents are incorporated by reference.

The reactant mixture may contain a boron-containing compound. Suitable boron-containing compounds include boron acids such as boric acid; esters of boron acids, e.g., mono-, di-, and tri-organic esters, with alcohols having 1 to 20 carbon atoms, e.g. methanol, ethanol, isopropanols, butanols, pentanols, hexanols, ethylene glycol, propylene glycol, and the like; and boron oxides such as boron oxide and boron oxide hydrate. A preferred boron-containing compound is boric acid.

Component (b), i.e., an inorganic phosphorus-containing compound, is well known and can be prepared by conventional methods. Examples of suitable inorganic phosphorus compounds include phosphorous acids and anhydrides. In particular, phosphorous acid, phosphoric acid, hypophosphoric acid, phosphorus trichloride, phosphorus trioxide, phosphorus tetraoxide, and phosphoric anhydride can be used. Phosphorous acid is most preferred. Aqueous solutions of the phosphorous acids are also useful.

Partial or total sulfur analogs of inorganic phosphorus-containing compounds, in which sulfur replaces one or more of the oxygens in the phosphorus compounds, can also be used. Suitable sulfur analogs are well known and can be prepared by conventional methods. Suitable sulfur analogs include phosphoromonothioic acid, phosphorodithioic acid, phosphorotrithioic acid, phosphorotetrathioic acid, and phosphorus pentasulfide.

Component (c), i.e., a mono- or di-sulfide-containing alkanol, includes compounds such as mono- or dithio-bis-alkanols and mono- or dithioalkanols. Examples of suitable mono- or dithio-bis-alkanols and mono- or dithioalkanols include compounds of formulae (V) and (VI):

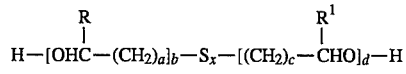

(V)

wherein R and $R^1$ independently represent H or an alkyl group; x represents 1 or 2; a and c independently represent an integer from 0 to 4; and b and d independently represent an integer from 1 to 3;

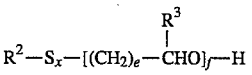

(VI)

wherein $R^2$ represents an alkyl group, $R^3$ represents H or an alkyl group, x represents 1 or 2, e represents an integer from 0 to 4, and f represents an integer from 1 to 3.

Preferred alkyl groups representative of R, R 1, and $R^3$ in formulae (V) and (VI) are alkyl groups containing one to ten carbon atoms.

The mono- or di-sulfide-containing alkanol preferably is a compound of formula (V), wherein R and $R^1$ are each H, x is 2, and a, b, c, and d are 1, i.e., 2,2'-dithiodiethanol.

Suitable mono- or di-sulfide-containing alkanols also can include polymeric mono- or di-sulfide-containing alkanols, for example, compounds of formula (VII):

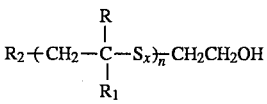

(VII)

wherein x represents 1 or 2; n is from about 2 to about 20, preferably 4 to about 10; R and $R_1$ independently are hydrogen or a $C_1$ to $C_{10}$ alkyl group; and $R_2$ is hydrogen or an alkyl group, aryl group, cycloalkyl group, or hetero-containing analog thereof. Suitable hetero atoms can include, but are not limited to, nitrogen, oxygen, phosphorus, and sulfur.

When one or two sulfur atoms are present in the alkanol, the alkanol is not considered to be "active" as defined by weight loss during, for example, the following copper compatibility test.

Copper Compatibility Test

The weight of copper lost from a copper strip upon immersion was measured to determine active sulfur-containing material. The procedure is outlined below.

A copper coupon having a size of about 70 mm×15 mm and a thickness of about 3 mm was cleaned and then weighed to the nearest tenth of a milligram. The cleaned coupon was placed in a test tube and completely covered with the material to be tested. The system was heated to 125° C. by means of an oil bath. After holding the system at 125° C. for three hours, the copper coupon was removed from the test tube and rinsed with heptane and then with acetone. The dried coupon was then rubbed with a paper towel moistened with acetone to remove any surface flakes formed by copper corrosion. The coupon was then air dried and weighed to the nearest tenth of a milligram. The results (in grams) are shown in Table 1:

TABLE 1

| Material Tested | Wt. of Coupon Before Test | Wt. of Coupon After Test | Wt. Loss |
|---|---|---|---|
| Dithiodiglycol | 26.3628 | 26.3615 | 0.0013 |
| Diluent Oil | 26.5880 | 26.5878 | 0.0002 |
| Mixture of 2% Dithiodiglycol and 98% Diluent Oil[1] | 26.5670 | 26.5656 | 0.0014 |

[1]The mixture was mixed at 50° C. for 30 minutes, but did not go into solution. It was added as such into the test tube.

The difference in weight between the initial copper coupon and the coupon after testing represents the extent to which the copper was corroded under the test conditions: the larger the weight difference, the greater the copper corrosion and the more active the sulfur compound. If the coupon weight loss is 30 milligrams or more, the sulfur-containing agent is considered active. In this invention, oil-soluble mono- or di-sulfide-containing agents yielding a weight loss of less than 30 mgs in the above test are desired.

Suitable mono- or di-sulfide-containing alkanols can readily be prepared by conventional methods and/or are commercially available. For example, dithiodiglycol can be prepared by oxidatively coupling two moles of mercaptoethanol.

The oil-soluble reaction product of this invention can be produced by reacting the basic nitrogen-containing compound, the inorganic phosphorus-containing compound, and the mono- or di-sulfide-containing alkanol in any order. For example, all components can be added together and reacted, for example, with heat. Preferably, the nitrogen-containing compound and the mono- or di-sulfide-containing alkanol are reacted first, and then the inorganic phosphorus-containing compound is added.

The temperature for the reaction can range from about 50° to about 185° C., preferably from 50° to 110° C. Most preferably, the reaction may be run in stages with a different temperature, ranging from about 50° to about 185° C., at each stage.

In a preferred embodiment, the mono- or di-sulfide-containing alkanol and the basic nitrogen compound are reacted first at a temperature of about 100° C., then a diluent oil is added, and the reaction is continued for a period of time ranging from about 0.5 to about 1.5 hours. The reaction is then cooled to about 50° C. The phosphorous compound is then added. After from about 0.5 to about 1.5 hours at 50° C., the reaction is then heated up to about 110° C. for the removal of water, which occurs when the phosphorus compound is an aqueous solution. The reaction is then completed at this temperature.

The time for the reaction may vary from about 3 hours to about 20 hours, but is generally set by the specific reactants and their concentrations. For example, in the preferred embodiment described above, the mono- or di-sulfide-containing alkanol and the nitrogen-containing compound are first reacted at about 100° C. for about 3 hours. After the addition of the diluent oil, the reaction is continued for about another hour. If the phosphorus compound is an aqueous $H_3PO_3$ solution, the reaction of the aqueous $H_3PO_3$ solution with the mono- or di-sulfide-containing alkanol, the basic nitrogen compound, and the diluent oil is allowed to continue for about one hour at 50° C. before the temperature is increased. Preferably, when the water is removed at 110° C., the removal is performed under reduced pressure, e.g. 40 mm Hg, and allowed to continue until it effectively ceases. In the preferred embodiment described above, water removal may take from about 2 to about 4 hours.

The reactant mixture may contain auxiliary basic nitrogen in a molar amount equal to or less than the molar amount of basic nitrogen provided by the at least one basic nitrogen containing compound. Preferred auxiliary nitrogen compounds are long chain primary, secondary, and tertiary alkyl mines containing from about 12 to 24 carbons atoms and their hydroalkyl derivatives. The long chain alkyl group may contain one or more ether groups. Examples of suitable compounds are oleyl amine, N-tallow diethanolamine, and myristyloxapropyl amine.

Other materials that are normally used in lubricant additives and that do not interfere with the reaction may also be added. For example, a small amount of a triazole such as tolyl triazole may be added as a copper passivator. Suitable triazoles include benzotriazole and alkyl-substituted benzotriazoles, preferably having one or two alkyl groups containing one to ten carbon atoms, most preferably one carbon atom. A more preferred triazole is tolyl triazole which is commercially available under the tradename Cobratec TT-100.

The amount of inorganic phosphorus employed ranges from about 0.1 to 3.0, preferably 1.0 to 1.5, moles per mole of basic nitrogen in the reaction mixture. As previously noted, an auxiliary nitrogen compound can contribute up to one half of the basic nitrogen.

The weight ratio of sulfur in the mono- or di-sulfide-containing alkanol to inorganic phosphorus in the phosphorus-containing compound may range from 0.1:1 to 10:1, preferably 5.5:1, more preferably 3.0:1.

The typical and preferred amounts (in wt. %) of reactants used to produce reaction products of the present invention will vary with the molecular weight of the reactants used, but should be chosen to reflect the mole and weight ratios described above.

The reaction product, including any optional auxiliary basic nitrogen compounds and triazole-derivative copper passivator, may be blended with other lubrication oil additives to form a concentrate or a fully finished lubricant formulation such as, for example, a power transmission fluid, particularly an automatic transmission fluid.

Typical lubrication oil additives include dispersants, corrosion inhibitors, detergents, pour point depressants, extreme pressure additives, viscosity index improvers, friction modifiers, and the like. These additives are disclosed in, for example, "Lubricant Additives" by C. V. Smalheer and R. Kennedy Smith, 1967, pp. 1–11 and U.S. Pat. No. 4,105,571. The disclosures of these publications are incorporated herein by reference.

Generally, a concentrate contains a major portion of the reaction product together with other desired additives and a minor amount of lubrication oil or other solvent. The reaction product and desired additives (i.e., active ingredients) in the concentrate are present in amounts that provide the desired concentration in a finished formulation. The collective amounts of active ingredient in the concentrate typically are from about 10 to 90 wt. %, preferably 25 to 75 wt. %, most preferably 40 to 60 wt. %. Any remainder is lubrication oil basestock.

A fully finished lubrication oil formulation may contain about 1 to 20 wt. % active ingredient with the remainder being lubrication oil basestock. However, the precise amount of active ingredient depends on the particular application. In addition, a fully finished lubrication oil formulation may contain additives based on the specific application. Representative amounts (in wt. %) of additives in lubrication oil formulations are:

| Additive | Broad Range | Preferred Range |
|---|---|---|
| VI Improvers | 1–12 | 1–4 |
| Corrosion Inhibitor/Passivators | 0.01–3 | 0.01–1.5 |
| Anti-Oxidants | 0.01–5 | 0.01–1.5 |
| Dispersants | 0.10–10 | 0.1–8 |
| Anti-Foaming Agents | 0.001–5 | 0.001–1.5 |
| Detergents | 0.01–6 | 0.01–3 |
| Anti-Wear Agents | 0.001–5 | 0.001–1.5 |
| Pour Point Depressants | 0.01–2 | 0.01–1.5 |
| Seal Swellants | 0.1–8 | 0.1–6 |
| Friction Modifiers | 0.01–3 | 0.01–1.5 |
| Lubricating Base Oil | Balance | Balance |

Lubrication oil basestocks may be derived from natural lubricating oils, synthetic lubricating oils, or mixtures thereof. In general, the lubricating oil basestock has a viscosity in the range of about 5 to about 10,000 $mm^2/S$ (cSt) at 40° C., although typical applications require an oil having a viscosity ranging from about 10 to about 1,000 $mm^2/S$ (cSt) at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g., dodecylbenzenes, tetradecylbenzenes, dinonylbenzenes, di(2-ethylhexyl)benzene, etc.); polyphenyls (e.g., biphenyls, terphenyls, alkylated polyphenyls, etc.); alkylated diphenyl ethers, alkylated diphenyl sulfides; derivatives, analogs, and homologs thereof; and the like.

Synthetic lubricating oils also include alkylene oxide polymers, interpolymers, copolymers, and derivatives thereof wherein the terminal hydroxyl groups have been modified by esterification, etherification, etc. Examples of this class of synthetic oils include polyoxyalkylene polymers prepared by polymerization of ethylene oxide or propylene oxide; alkyl and aryl ethers of these polyoxyalkylene polymers (e.g., methyl-polyisopropylene glycol ether having an average molecular weight of 1000, diphenyl ether of polyethylene glycol having a molecular weight of 500–1000, and diethyl ether of polypropylene glycol having a molecular weight of 1000–1500); and mono- and poly-carboxylic esters of these polyalkylene polymers (e.g., acetic acid esters, mixed $C_3$ to $C_8$ fatty acid esters, and $C_{13}$ oxo acid diester of tetraethylene glycol).

Another suitable class of synthetic lubricating oils includes esters of dicarboxylic acids (e.g., phthalic acid, succinic acids, alkyl succinic acids, alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) in combination with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, and the like. Synthetic hydrocarbon oils can be obtained from hydrogenated oligomers of normal olefins.

Silicone-based oils (e.g., polyalkyl-, polyaryl-, polyalkoxy-, or polyaryloxysiloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hex-(4-methyl-2-pentoxy)-disiloxane, poly(methyl)-siloxanes and poly(methylphenyl) siloxanes, and the like.

Other synthetic lubricating oils include liquid esters of phosphorus-containing acids (e.g., tricresyl phosphate, trioctyl phosphate, and diethyl ester of decylphosphonic acid), polymeric tetrahydrofurans, polyalphaolefins, and the like.

Suitable lubricating oil may be derived from unrefined, refined, rerefined oils, or mixtures thereof. Unrefined oils may be directly obtained from a natural source or synthetic source (e.g., coal, shale, or tar sands bitumen) without further purification or treatment. Examples of unrefined oils include a shale oil directly obtained from a retorting operation, a petroleum oil directly obtained from distillation, or an ester directly obtained from an esterification process. These unrefined oils may then be used without further treatment.

Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils may be obtained by treating refined oils in processes similar to those used to obtain the refined oils. These rerefined oils are also known as reclaimed or reprocessed oils and are frequently processed further by techniques for removing spent additives and oil breakdown products.

This invention may be further understood from the following examples which are not intended to restrict the scope of the appended claims.

I. PREPARATIVE EXAMPLES

A. Preparation 1

250.0 gms of a polybutenylsuccinimide of polyethylenepolyamine in which the polybutenyl group has a number average molecular weight of about 450 ("450 MW PIBSA PAM"), 810.0 gms of solvent 75 neutral ("S75N"), and 321.3 gms of 70% aqueous phosphorous acid ("$H_3PO_3$") were charged to a 5 liter round bottomed flask equipped with a mechanical stirrer, an overhead condenser with a Dean-Stark trap, a thermometer, and a heating mantle. The reactor contents were heated to 100° C. with stirring and held at that temperature for two hours. The pressure in the reaction apparatus was then gradually reduced to 40 mm Hg using a vacuum pump that was protected with a dry ice trap. Water was condensed overhead and collected in the Dean-Stark trap. The temperature was gradually raised to 110° C. after a stable vacuum was obtained, and the reaction mixture was held at that temperature for an additional hour under vacuum. The vacuum pump was shut down and the pressure was increased to atmospheric by admission of nitrogen. The reactor contents were cooled and removed.

103.1 grams of water condensed overhead. The product had an acid number of 106.9 mgKOH/gm.

B. Preparation 2

249.9 gms of 450 MW PIBSA PAM and 124.4 gms of dithiodiglycol ("DTDG") were charged to a 1 liter round bottomed flask equipped as in Preparation 1. After briefly flushing the apparatus with nitrogen, the reactor contents were heated to 100° C. with stirring and held at that temperature for three hours. 90.0 gms of S75N were then added, and the reaction was heated for an additional hour at 100° C. The reactor was then cooled to 50° C., and 35.8 gms of 70% aqueous $H_3PO_3$ were added. The reactor contents were stirred at about 50° C. for another hour. The pressure in the reaction apparatus was then gradually reduced to 40 mm Hg using a vacuum pump that was protected with a dry ice trap, and the temperature was gradually raised to 110° C. Water was condensed overhead and collected in the Dean-Stark trap. After 2.5 hours at 110° C. and 40 mm Hg, the vacuum pump was shut down and the pressure was increased to atmospheric by admission of nitrogen. The reactor contents were cooled and removed.

12.5 gms of water condensed overhead. The product had an acid number of 65.7 mgKOH/gm.

C. Preparation 3

250.0 gms of 450 MW PIBSA PAM and 124.4 gms of DTDG were charged to a 1 liter round bottomed flask equipped as in Preparation 1. After briefly flushing the apparatus with nitrogen, the reactor contents were heated to 100° C. with stirring and held at that temperature for two hours. At the end of the two hour heating period, 90.1 gms of S75N were added, and the reaction was heated for an additional hour at 100° C. The reactor was then cooled to 50° C., and 35.7 gms of 70% aqueous $H_3PO_3$ were added. The reactor contents were then stirred at about 50° C. for another hour. The pressure in the reaction apparatus was then gradually reduced to 40 mm Hg using a vacuum pump that was protected with a dry ice trap, and the temperature was gradually raised to 110° C. Water was condensed overhead and collected in the Dean-Stark trap. After 3.3 hours at 110° C. and 40 mm Hg, the vacuum pump was shut down and the pressure was increased to atmospheric by admission of nitrogen. The reactor contents were cooled and removed.

13.5 gms of water condensed overhead. The product had an acid number of 67.7 mgKOH/gm.

D. Preparation 4

250.4 gms of a polybutenylsuccinimide of polyethylenepolyamine in which the polybutenyl group has a molecular weight of about 900 ("900 MW PIBSA PAM"), 90.0 gms of S75N, and 25.7 gms of 70% aqueous $H_3PO_3$ were charged to a 1 liter round bottomed flask equipped as in Preparation 1. The reactor contents were heated to 100° C. with stirring and held at that temperature for two hours. The pressure in the reaction apparatus was then gradually reduced to 40 mm Hg using a vacuum pump that was protected with a dry ice trap. Water was condensed overhead and collected in the Dean-Stark trap. When a stable vacuum was obtained, the temperature was gradually raised to 110° C., and the reaction mixture was held at that temperature for an additional hour under vacuum. The vacuum pump was shut down and the pressure was increased to atmospheric by admission of nitrogen. The reactor contents were cooled and removed.

6.9 grams of water condensed overhead. The product had an acid number of 115.8 mgKOH/gm.

E. Preparation 5

250.2 gms of 900 MW PIBSA PAM and 48.2 gms of DTDG were charged to a 1 liter round bottomed flask equipped as in Preparation 1. After briefly flushing the apparatus with nitrogen, the reactor contents were heated to 100° C. with stirring and held at that temperature for three hours. 90.1 gms of S75N were added, and the reaction was heated for an additional hour. 25.7 gms of aqueous $H_3PO_3$ were then added. The temperature was then raised to 110° C., and the reactor contents were stirred for one-half hour at this temperature. The pressure in the reaction apparatus was then gradually reduced to 40 mm Hg using a vacuum pump that was protected with a dry ice trap. Water was condensed overhead and collected in the Dean-Stark trap. After four hours at 110° C. and 40 mm Hg, water ceased condensing overhead, the vacuum pump was shut down, and the pressure was increased to atmospheric by admission of nitrogen. The reactor contents were cooled and removed.

8.2 gms of water condensed overhead. The product had an acid number of 72.3 mgKOH/gm.

| | Preparation Analysis | | |
|---|---|---|---|
| | Theoretical Weight % | | |
| Preparation | Nitrogen | Phosphorus | Sulfur |
| 1 | 2.45 | 2.59 | — |
| 2 | 1.83 | 1.94 | 10.61 |
| 3 | 1.82 | 1.92 | 10.53 |

-continued

| Preparation | Preparation Analysis Theoretical Weight % Nitrogen | Phosphorus | Sulfur |
|---|---|---|---|
| 4 | 1.10 | 1.89 | — |
| 5 | 0.98 | 1.68 | 4.95 |

II. PERFORMANCE EXAMPLES

A. Wear Testing

Test Fluids A, B, C., and D were formulated with a total of 8.304 wt. % of dispersant, anti-oxidant, friction modifier, seal swellant, anti-foamant, and viscosity index improver and the following amounts of a Preparation additive and base oil. The parts per million of phosphorus in each test fluid was 250.

| Components | A | B | C | D |
|---|---|---|---|---|
| Preparation 1 | 0.97 | — | — | — |
| Preparation 2 | — | 1.04 | — | — |
| Preparation 4 | — | — | 1.31 | — |
| Preparation 5 | — | — | — | 1.06 |
| Base Oil | to 100 | to 100 | to 100 | to 100 |

Test fluids A to D were run in the FZG Gear Test. The test and test apparatus is fully described in the DIN 51354 and CEC L-07-A-75 official standards. In this test, the test fluid is run using test gears at increasing loads or load stages. There are thirteen possible load stages. Achieving a high load stage before scoring of the tooth flank, defined as "stage failure", is desirable, i.e., a better result is achieved if a higher number of stages is run before the gear surfaces become damaged. The test results are shown in Table A.

TABLE A

| Test Fluid | MW | Product | Stages Passed |
|---|---|---|---|
| A | 450 | Phosphorus only | 10 |
| B | 450 | Phosphorus plus di-sulfide | 13 |
| C | 900 | Phosphorus only | 10 |
| D | 900 | Phosphorus plus di-sulfide | 13 |

The results show that Test Fluids B and D are superior in extreme pressure performance to the products that do not contain a sulfide moiety.

B. Friction Performance

Test fluids W, X, Y, and Z were formulated with a total of 8.02 wt. % of dispersant, anti-oxidant, friction modifiers, and viscosity index improver and the following amounts (in wt. %) of a Preparation additive and base oil/anti-foamant. The parts per million of phosphorus in each test fluid was 200.

| Components | W | X | Y | Z |
|---|---|---|---|---|
| Preparation 1 | 0.77 | — | — | — |
| Preparation 3 | — | 0.92 | — | — |
| Preparation 4 | — | — | 1.05 | — |
| Preparation 5 | — | — | — | 0.85 |

-continued

| Components | W | X | Y | Z |
|---|---|---|---|---|
| Base Oil + Anti-Foamant | to 100 | to 100 | to 100 | to 100 |

A desirable characteristic of automatic transmission fluids is the provision of high levels of dynamic friction. One test method useful for assessing the dynamic friction coefficient provided by a fluid (reported as dynamic torque in Newton-Meters (NM)) is the General Motors 3T40 Band Friction Test. This test is described in the General Motors DEXRON-III Automatic Transmission Fluid Specification, GM-6297M, April 1993.

The level of dynamic friction provided by test fluids W to Z was determined by running the test fluids in the 3T40 Band Friction Test for 24,000 cycles. The average level of dynamic friction torque provided by these fluids from 4,000 to 24,000 cycles is shown in Table B.

TABLE B

| Test Fluid | MW | Product | Dynamic Torque (NM) |
|---|---|---|---|
| W | 450 | Phosphorus only | 183 |
| X | 450 | Phosphorus plus di-sulfide | 212 |
| Y | 900 | Phosphorus only | 195 |
| Z | 900 | Phosphorus plus di-sulfide | 206 |

The results show that Test Fluids X and Z provide superior levels of dynamic friction as compared to products which do not contain a sulfide moiety.

What is claimed is:

1. An oil-soluble reaction product composition comprising:

(a) at least one reaction product of hydrocarbyl-substituted succinic acids and succinic anhydrides with polyamines (b) at least one inorganic phosphorus-containing compound, and (c) at least one mono- or di-sulfide-containing alkanol.

2. The composition of claim 1, wherein the at least one inorganic phosphorus-containing compound is selected from the group consisting of phosphorus acid, phosphoric acid, hypophosphoric acid, phosphorus trichloride, phosphorus trioxide, phosphorus tetraoxide, and phosphoric anhydride.

3. The composition of claim 1, wherein the at least one inorganic phosphorus-containing compound is selected from the group consisting of phosphoromonothioic acid, phosphorodithioic acid, phosphorotrithioic acid, phosphorotetrathioic acid, and phosphorus pentasulfide.

4. The composition of claim 1, wherein the at least one mono- or di- sulfide-containing alkanol is selected from the group consisting of compounds of formula (V) and formula (VI):

$$H-[\overset{\overset{R}{|}}{OHC}-(CH_2)_a]_b-S_x-[(CH_2)_c-\overset{\overset{R^1}{|}}{CHO}]_d-H \quad (V)$$

wherein R and $R^1$ independently represent H or an alkyl group; x represents 1 or 2; a and c independently represent an integer from 0 to 4; and b and d independently represent an integer from 1 to 3;

$$R^2-S_x-[(CH_2)_e-\overset{\overset{\displaystyle R^3}{|}}{C}HO]_f-H \quad \text{(VI)}$$

wherein $R^2$ represents an alkyl group; $R^3$ represents H or an alkyl group; x represents 1 or 2; e represents an integer from 0 to 4; and represents an integer from 1 to 3.

5. The composition of claim 4, wherein the at least one mono- or di- sulfide-containing alkanol is 2,2'-dithiodiethanol.

6. The composition of claim 1 wherein (b) is phosphorous acid, and (c) is 2,2' dithiodiethanol.

7. A lubrication oil composition comprising a major amount of a lubrication oil and an amount of the composition of claim 1 effective to improve friction and/or wear performance.

8. An oil-soluble additive concentrate comprising a minor amount of a diluent oil and a major amount of the composition of claim 1.

9. A method of improving friction and/or wear performance of a lubrication oil by adding an effective amount of the composition of claim 1 to the lubrication oil.

* * * * *

UNITED STATES PATENT AND TRADEMARK OFFICE

CERTIFICATE OF CORRECTION

PATENT NO. : 5,468,403
DATED : November 21, 1995
INVENTOR(S) : Michael G. Romanelli, et al It is certified that error appears in the above-indentified patent and that said Letters Patent is hereby corrected as shown below:

In claim 2, Column 14, line 44, after "wherein" delete "the".

In claim 3, Column 14, line 49, after "wherein" delete "the".

In claim 4, Column 14, line 54, after "wherein" delete "the".

In claim 4, Column 15, line 7, before the word "represents" insert -- f --.

In claim 5, Column 15, line 9, after "wherein" delete "the".

Signed and Sealed this

Twentieth Day of August, 1996

*Attest:*

Bruce Lehman

BRUCE LEHMAN

*Attesting Officer*

*Commissioner of Patents and Trademarks*